US007309023B2

(12) United States Patent
Kaiser

(10) Patent No.: US 7,309,023 B2
(45) Date of Patent: Dec. 18, 2007

(54) SELF-ADJUSTING FLEXIBLE TRACK FOR USE WITH ELECTRIC MODEL VEHICLES

(76) Inventor: Steven Kaiser, 39 Salem Pl., Cliffwood, NJ (US) 07721

( * ) Notice: Subject to any disclaimer, the term of this patent is extended or adjusted under 35 U.S.C. 154(b) by 259 days.

(21) Appl. No.: 11/035,143

(22) Filed: Jan. 13, 2005

(65) Prior Publication Data

US 2006/0151625 A1 Jul. 13, 2006

(51) Int. Cl.
*E01B 23/00* (2006.01)

(52) U.S. Cl. ..... 238/10 R; 238/10 E; 238/10 F

(58) Field of Classification Search ..... 268/10 R, 268/11, 10 A, 10 B, 10 C, 10 E, 10 F; 446/444, 446/445, 446, 447
See application file for complete search history.

(56) References Cited

U.S. PATENT DOCUMENTS

| | | | | |
|---|---|---|---|---|
| 2,120,251 | A * | 6/1938 | Johnson | 238/10 E |
| 3,013,726 | A | 12/1961 | Orel | |
| 3,276,393 | A | 10/1966 | Lewis | |
| 3,308,576 | A | 3/1967 | Nadolny | |
| 3,596,397 | A | 8/1971 | Collatti | |
| 3,797,401 | A | 3/1974 | Alimanestianu | |
| 4,095,743 | A * | 6/1978 | Birdsall | 238/10 F |
| 4,260,104 | A * | 4/1981 | Schaffan | 238/10 E |
| 4,352,329 | A * | 10/1982 | Fetty et al. | 104/305 |
| 4,418,152 | A | 11/1983 | Hosaka et al. | |
| 4,479,650 | A | 10/1984 | Neuhierl | |
| 4,817,867 | A | 4/1989 | Schuller | |
| 5,461,984 | A | 10/1995 | Andress, III | |
| 5,657,695 | A | 8/1997 | Lanoix et al. | |
| 5,947,794 | A | 9/1999 | McGrath | |
| 6,263,799 | B1 | 7/2001 | Pardes | |
| 6,648,723 | B2 | 11/2003 | Clark, Jr. et al. | |
| 2001/0029865 | A1 | 10/2001 | Clark, Jr. et al. | |

* cited by examiner

*Primary Examiner*—Mark T. Le
(74) *Attorney, Agent, or Firm*—Patterson & Sheridan LLP

(57) ABSTRACT

One embodiment of self-adjusting flexible track for use with electric model vehicles includes a flexible base and at least two flexible channels coupled to the flexible base. The flexible channels are adapted to directly support travel of the electric model vehicle. Moreover, the flexible channels are adjustable such that bending forces applied to the track do not alter the geometry of a track connection interface. Thus, the self-adjusting flexible track may be bent into virtually any shape without the need to modify the connection interface for connection to a second track.

6 Claims, 5 Drawing Sheets

SELF-ADJUSTING FLEXIBLE TRACK FOR USE WITH ELECTRIC MODEL VEHICLES

BACKGROUND OF THE INVENTION

1. Field of the Invention

This invention relates generally to electric model vehicles and relates more particularly to tracks for use with electric model vehicles.

2. Description of the Background Art

Electric model vehicles (e.g., slot cars and other vehicles) are popular among collectors and hobbyists, with various magazines, social clubs and specialty stores being devoted to the subject. Many electric model vehicle enthusiasts prefer to construct or customize their own track layouts by arranging pre-made sections of track in a desired configuration. These pre-made track sections typically comprise a base of a fixed shape (e.g., straight or curved) having two channels or tracks for engaging an electric model vehicle.

However, users are afforded limited flexibility when it comes to configuring a custom track. Pre-made track sections are typically rigid components with little or no flexibility. Some pre-made track sections are easier to bend into a desired shape, but are difficult to adapt for connection to additional track sections. For example, as a straight section of track is bent along its longitudinal axis (e.g., into a curved shape), the ends of the fixed-length channels are forced to jut out from the ends of the track. In order to connect the bent track section to an additional track section, a user must carefully cut the channels of the bent track section to create an even connection interface. This is a tedious and cumbersome job.

Thus, there is a need in the art for a self-adjusting flexible track for use with electric model vehicles.

SUMMARY OF THE INVENTION

One embodiment of self-adjusting flexible track for use with electric model vehicles includes a flexible base and at least two flexible channels coupled to the flexible base. The flexible channels are adapted to directly support travel of the electric model vehicle. Moreover, the flexible channels are adjustable such that bending forces applied to the track do not alter the geometry of a track connection interface.

One advantage of the disclosed invention is that, among other things, the adjustable nature of the channels allows a user to bend the track section into virtually any shape with little to no modification.

DETAILED DESCRIPTION OF THE INVENTION

The invention will be described within the context of a self-adjusting flexible track for use with electric model vehicles. It will be appreciated by those skilled in the art that virtually any type of electric model vehicle (e.g., automobiles, trains, etc.) may be adapted for use with the present invention, and that such uses are contemplated by the inventor. As used herein, the term "track" refers to a segment of track that, alone or combined with one or more other segments of track, forms a complete track layout upon which an electric model vehicle may travel.

Figure 1:
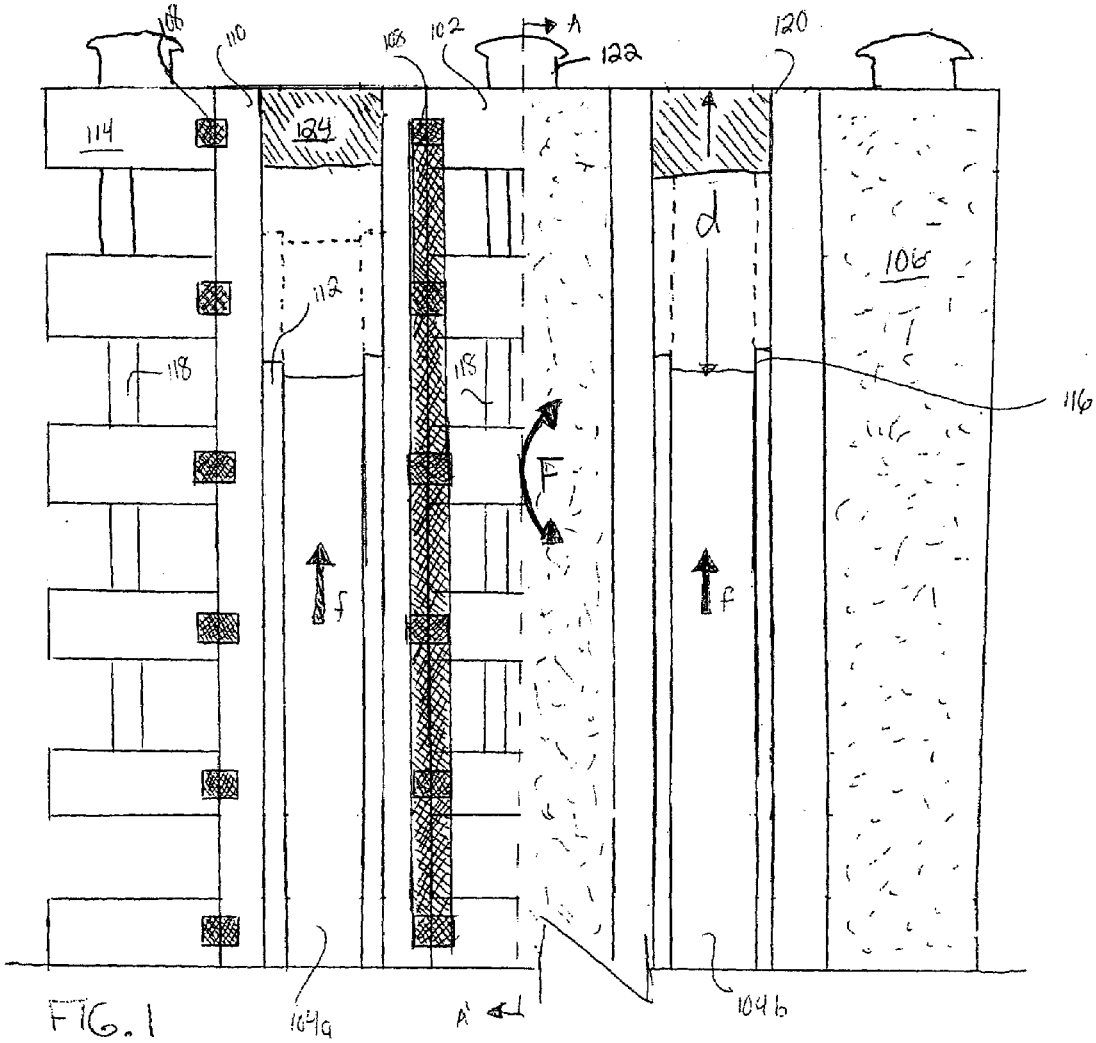
FIG. 1 is a partial top view of one embodiment of a self-adjusting flexible track according to the present invention.

FIG. 1 is a partial top view of one embodiment of a self-adjusting flexible track 100 according to the present invention. Specifically, FIG. 1 depicts one end of a self-adjusting flexible track 100; a full self-adjusting flexible track 100 is substantially a mirror image about the illustrated break line. As illustrated, a self-adjusting flexible track 100 includes a flexible base 102 and two flexible channels 104*a* and 104*b* (hereinafter collectively referred to as "flexible channels 104") coupled to the flexible base 102.

The flexible base 102 is formed of a flexible material, such as a flexible plastic. In one embodiment, the flexible base 102 is configured in a manner similar to a model railroad layout and includes a plurality of spaced-apart ties 114 (e.g., as illustrated to the left of longitudinal axis A-A'). In another embodiment, the flexible base 102 includes a textured or sculpted surface 106, such as a simulated roadbed (e.g., as illustrated to the right of longitudinal axis A-A').

In either case, the flexible base 102 also comprises an anchoring mechanism, such as one or more spikes 108 positioned on both sides of the flexible channels 104, for holding the flexible channels 104 in place. In one embodiment, a set of spikes 108 for securing a single flexible channel 104 comprises two spikes 108 that run the entire length of the flexible base 102 (e.g., as illustrated to the right of the flexible channel 104*a*). In another embodiment, a plurality of shorter spikes 108 are spaced along the length of the flexible base 102 (e.g., one spike 108 per tie 114, as illustrated to the left of the flexible channel 104*a*) to enhance flexibility of the self-adjusting flexible track 100.

In one embodiment, where at least an underlying structure of the flexible base comprises a plurality of spaced-apart ties 114, the flexible base 102 further comprises at least one spacer 118 for maintaining a uniform distance between two or more ties 114. In one embodiment, the spacer 118 is a mechanism that runs substantially parallel to the flexible channels 104 and intersects one or more ties 114. The spacer 118 prevents the ties 114 with which it intersects from being moved closer together or further apart as the self-adjusting flexible track 100 is bent along its longitudinal axis A-A'. The spacer 118 may be positioned on either side (or both sides) of a flexible channel 104. In one embodiment, a spacer 118 is formed integrally with the flexible base 102; in another embodiment, a spacer 118 is formed as a separate component that may be selectively deployed within a desired portion of the flexible base 102.

Each flexible channel 104 comprises two main components: a conductive flexible outer channel 110 and a conductive flexible inner channel 112. The inner and outer channels 110 and 112, like the flexible base 102, are also formed of a flexible material. In one embodiment, both the outer channel 110 and the inner channel 112 have substantially U-shaped cross sections (as illustrated in greater detail in FIG. 2) and are adapted to enable a model electric vehicle to travel along the length of the flexible channels 104. The inner channel 112 has an outer width that is slightly smaller than an inner width of the outer channel 110, so that the inner channel 112 may be retained securely within the outer channel 110 while remaining free to slide longitudinally within the outer channel 110.

As illustrated, the inner channel 112 of a flexible channel 104 is shorter in length than the outer channel 110, so that a variable distance, d, remains between an end 116 of the inner channel 112 and an end 120 of the outer channel 110 at each end of the flexible channel 104. The inner channel 112 is thereby enabled to slide longitudinally within the outer channel 110, so that the flexible channel 104 automatically adjusts as force is applied to bend the self-adjusting flexible track 100 along the longitudinal axis A-A'.

That is, as the self-adjusting flexible track 100 is bent along its longitudinal axis A-A' (e.g., as illustrated by arrow F), the inner channel 112 slides (e.g., as illustrated by arrows f) inside the outer channel 110 toward the end 120 of the outer channel 110 (as illustrated in phantom), minimizing the variable distance d. The inner channel 112 that is part of the inner flexible channel 104 (e.g., the flexible channel 104 that is radially inward when the track 100 is bent, such as the flexible channel 104*b* in the illustrated embodiment) will typically slide further than the inner channel 112 that is part of the outer flexible channel 104 (e.g., flexible channel 104*a*). A stop 124 is positioned within the end 120 of the outer channel 110 to limit travel of the inner channel 112, e.g., to prevent the inner channel 112 from sliding past the end of the self-adjusting flexible track 100. The flexible channels 104 therefore are enabled to adapt to the applied bending force F without modification (e.g., cutting).

Thus, a self-adjusting flexible track 100 constructed according to embodiments of the present invention may be configured or customized according to a user's specifications with little or no need to modify the track 100 for connection to additional tracks. The flexible channels 104 of the self-adjusting flexible track 100 automatically adjust as the track 100 is bent into shape, so that the track 100 may be easily connected to an additional track (e.g., by simply snapping a connector 122 on the track 100 into an engaging slot—202 in FIG. 2—of another track) without modifying the track's connection interface. This saves a user a lot of time and effort and substantially prevents mistakes due to the cutting of the rails.

Although the invention as illustrated depicts a flexible base 102 having two flexible channels 104 coupled thereto (e.g., forming a single lane on which an electric model vehicle may travel), those skilled in the art will appreciate that a flexible base 102 may be constructed with any even number of flexible channels 104, in order to provide multiple lanes along which electric model vehicles may travel.

Figure 2:
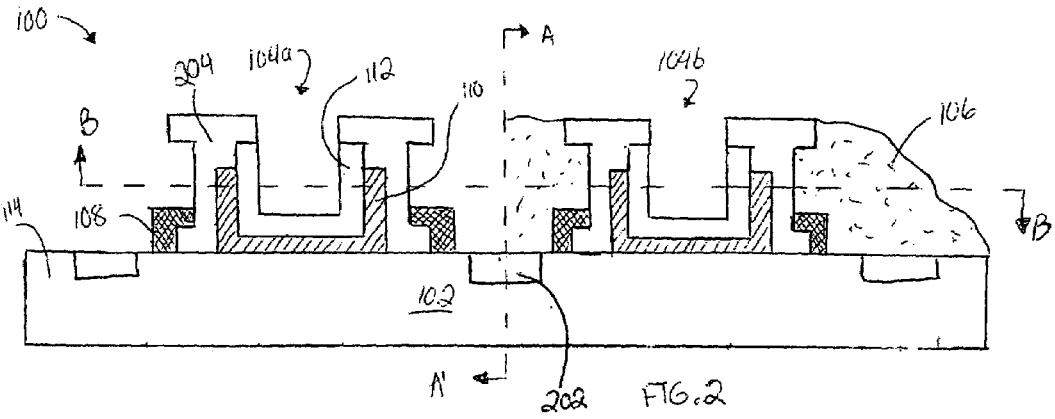
FIG. 2 is a cross sectional view of the self-adjusting flexible track illustrated in FIG. 1.

FIG. 2 is a cross sectional view of the self-adjusting flexible track 100 illustrated in FIG. 1. Specially, FIG. 1 depicts a top view of the self-adjusting flexible track 100 of FIG. 2 taken below the line B-B' of FIG. 2, so that the detail of the flexible channels 104 can be illustrated.

As described above, the flexible channels 104 are held in place on the flexible base 102 by an anchoring mechanism coupled to the flexible base 102, such as one or more spikes 108. In one embodiment, one or more additional anchoring mechanisms, such as J-beams 204, may be implemented in conjunction with the spikes 108 in order to hold the flexible channels 104 in place. For example, as illustrated, a J-beam 204 has a substantially J-shaped cross section that is adapted to catch beneath a spike 108 and to clamp down over the outer and inner channels 110 and 112 of a flexible channel 104. In one embodiment, the J-beam 204 is stepped so that both the outer channel 110 and the inner channel 112 are securely biased toward the flexible base 102 by the J-beam 204. In one embodiment, the J-beams 204 are not permanently fixed to the flexible base 102 or to the flexible channels 104, but may be slid into and out of place as the self-adjusting flexible track 100 is constructed or dismantled.

Figure 3:
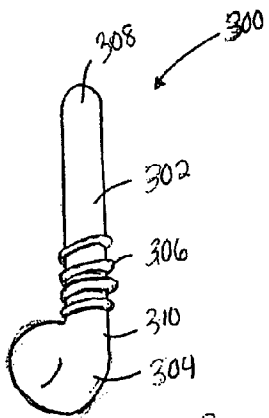
FIG. 3 is a perspective view of one embodiment of an automobile adapter for adapting an electric model vehicle for use with the self-adjusting flexible track of FIG. 1.

FIG. 3 is a perspective view of one embodiment of a vehicle adapter 300 for adapting an electric model vehicle (e.g., a slot car) for use with the self-adjusting flexible track 100. The vehicle adapter 300 is configured to couple power from the self-adjusting flexible track 100 to a model vehicle (e.g., 400 in FIG. 4), thereby enabling the model vehicle to travel along the rails 104 of the self-adjusting flexible track 100. The vehicle adapter 300 includes a shaft 302, a shoe 304 and a biasing member 306. The shaft 302 includes a first end 308 and a second end 310, the first end 308 being adapted for engaging an electric model vehicle. The shoe 304 is coupled to the second end 310 of the shaft 302 and is sized to slidably engage one of the flexible channels 104 of the self-adjusting flexible track 100. The biasing member 306 is adapted to stabilize an electric model vehicle on the flexible channels 104 and to secure the vehicle adapter 300 to the electric model vehicle. In one embodiment, the biasing member 306 is a coil spring fitted onto the shaft 302, axially inward of the shoe 304.

Figure 4:
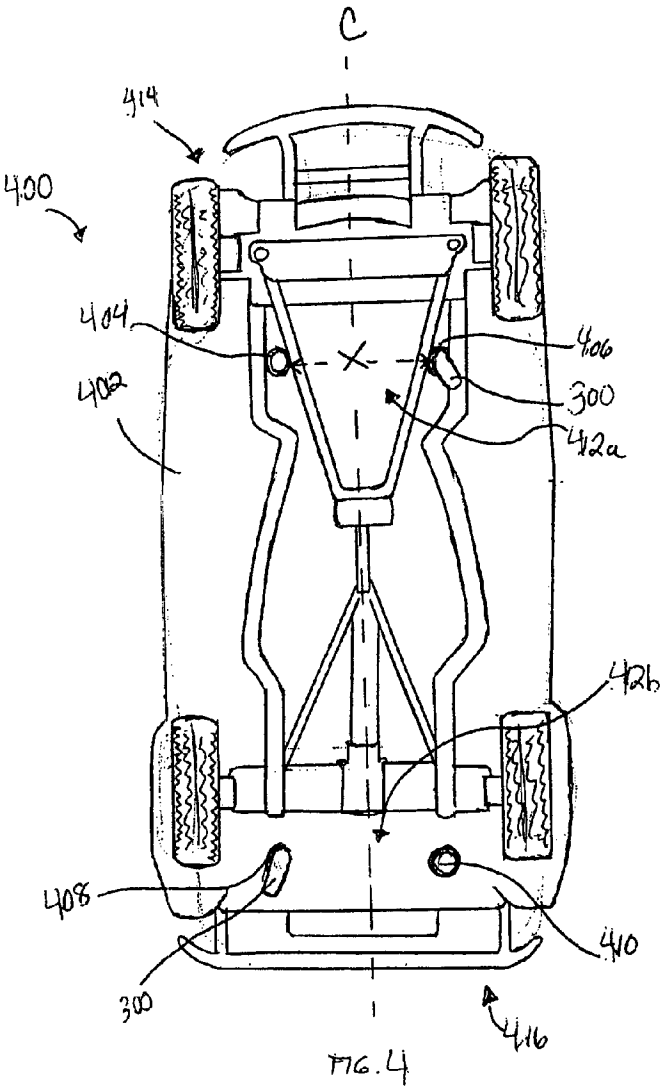
FIG. 4 is a bottom view of an exemplary electric model automobile that may be adapted for use with the self-adjusting flexible track of FIG. 1.

FIG. 4 is a bottom view of an exemplary electric model automobile 400 that may be adapted for use with the self-adjusting flexible track 100. As illustrated, an underside 402 of the model automobile 400 includes at least a first bore 404 and a second bore 406 formed therein. The first and second bores 404, 406 are positioned on opposite sides of an automobile centerline C, and are spaced apart by a distance x that is substantially equal to a distance separating the rails 104*a* and 104*b* of the self-adjusting flexible track 100. The first and second bores 404, 406 are each sized to receive a shaft 308 of an automobile adapter 300, such as the automobile adapter 300 illustrated in FIG. 3, so that the shoe 304 protrudes from the underside 402 of the model automobile 400.

In the embodiment illustrated in FIG. 4, third and fourth bores 408, 410 are formed in the underside 402 of the model automobile 400 to form two sets 412*a*, 412*b* of bores 404-410: a first set 412*a* positioned toward a front 414 of the model automobile 400 and a second set 412*b* positioned toward a back 416 of the model automobile 400. Those skilled in the art will appreciate that any number of bores 404-410 may be formed in the model automobile 400, depending on the number of automobile adapters 300 necessary to achieve a desired degree of stability for the model automobile 400 upon the rails 104. Furthermore, although a model automobile 400 has been described that may be adapted (e.g., retrofit) to use the automobile adapters 300, those skilled in the art will appreciate that the model automobile 400 and automobile adapter 300 may be formed integrally at the manufacturing level.

Other embodiments of the present invention provide adapters for enabling a user to modify a traditional model railroad layout to allow electric model automobiles to travel thereon.

Figure 5:
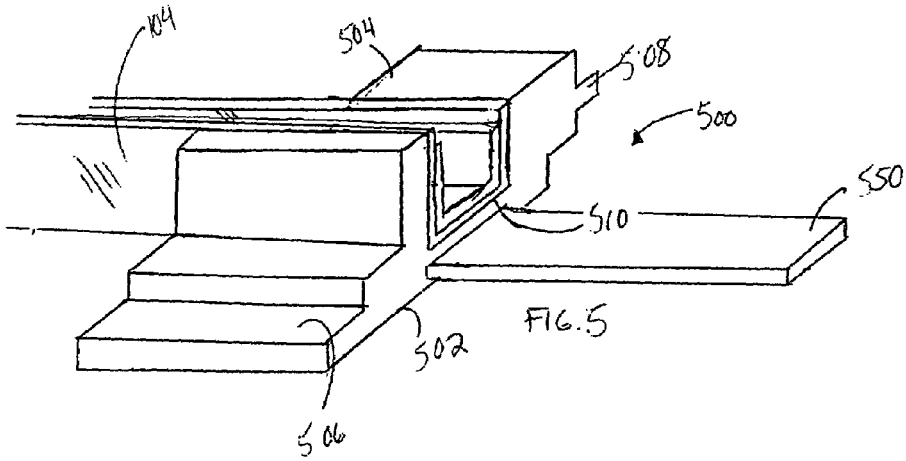
FIG. 5 is an isometric view of one embodiment of a model railroad track adapter according to the present invention.
Figure 6:
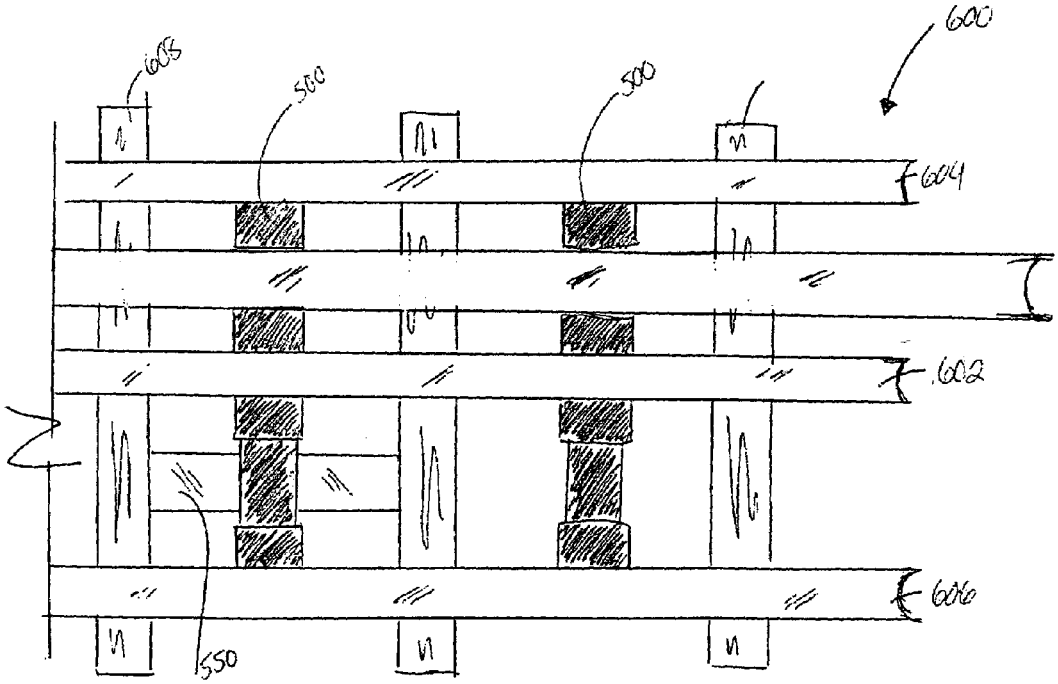
FIG. 6 is a top view of a model railroad track layout in which the model railroad track adapter of FIG. 5 is deployed.

FIG. 5 is an isometric view of one embodiment of a model railroad track adapter 500 according to the present invention. FIG. 6 is a top view of a model railroad track layout 600 in which the model railroad track adapter 600 is deployed. The model railroad track adapter 500 is configured to be positioned between a center train rail 602 and one of a first side train rail 604 or a second side train rail 606.

The track adapter 500 comprises a first face 502, a second face 504, a step 506, a locking mechanism 508 and a groove 510. The first face 502 is adapted to lie substantially flat against the bottom of the model railway track layout 600. The second face 504 has the groove 510 formed therein. The groove 510 is sized to receive an electric model automobile channel (e.g., a slot car channel) such as the flexible channels 104 illustrated in FIG. 1. In one embodiment, the groove 510 is a substantially U-shaped channel that extends along the length of the track adapter 500. The step 506 extends outward from the first face 502 of the track adapter 500, and is positioned laterally from the groove 510 in order to engage the first or second side train rail 604 or 606 (e.g., by catching underneath the train rail 604, 606). The locking mechanism 508 comprises a lateral protrusion that extends from an opposite lateral side of the groove 510 and is adapted to catch under a lip of the center train rail 602, thereby securing the track adapter 500 in place.

In one embodiment, the track adapter 500 further includes a spacer 550 that projects outwardly from the first face 502 in a manner substantially parallel to the groove 510. The spacer 550 is sized to abut each tie 608 that is adjacent to the track adapter 500 and to bias the ties 608 away from the track adapter 500. The spacer 550 thereby maintains a fixed distance between the ties 608 on either side of the track adapter 500.

A plurality of track adapters 500 may be positioned at intervals along the length of the train rails 602-606 (e.g., between the ties 608), in order to adapt a model railroad track layout 600 for use with flexible electric model automobile channels (e.g., flexible channels 104).

The track adapter's clip-like structure makes it particularly well-suited for use with flexible electric model automobile channels, because the track adapter 500 is not a large, rigid component. Thus, a flexible model railroad layout rail may be bent or curved into substantially any configuration, and track adapters 500 spaced at intervals along the length of the layout will interface the flexible electric model automobile channels thereto, making the model railroad track layout a dual-purpose (e.g., model railroad train and electric model automobile) track. An additional degree of versatility is thereby added to traditional model railroad layouts and to flexible electric model automobile channels.

Figure 7:
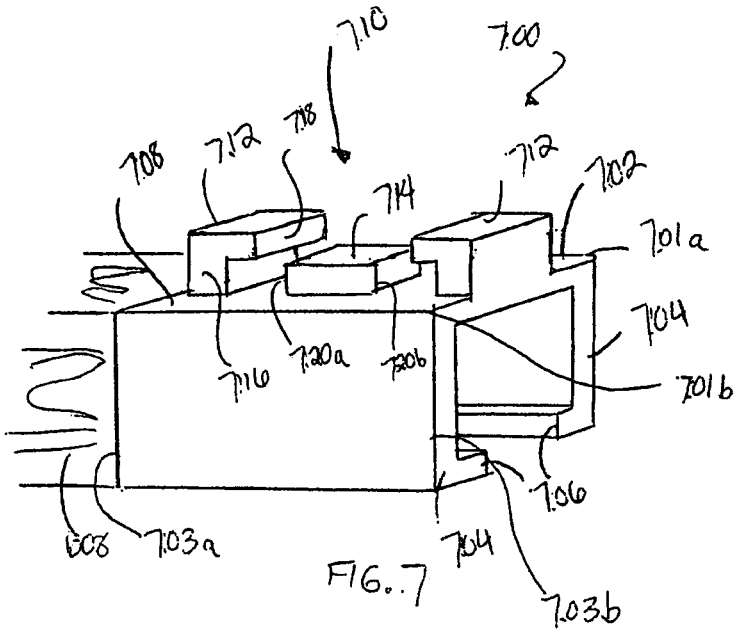
FIG. 7 is an isometric view of a second embodiment of a track adapter.

FIG. 7 is an isometric view of a second embodiment of a track adapter 700. Unlike the track adapter 500, which is configured to be positioned between the center train rail 602 and a side train rail 604 or 606, the track adapter 700 is adapted to be coupled to a model railroad tie (e.g., tie 608 of FIG. 6), for example by snapping over the tie 608 or by using adhesive (e.g., for a track having a simulated roadbed). Moreover, the track adapter 700 is adapted to receive an anchoring mechanism (e.g., a J-beam, as illustrated in FIG. 2) for securing a flexible model electric automobile channel to a model railroad track layout.

In one embodiment, the track adapter 700 comprises a substantially rectangular base 702 having two arms 704 extending from opposite edges 701*a* and 701*b* of the base 702 at angles substantially normal to the base 702. The arms further comprise flanges 706 adapted for wrapping around a base of the tie 608. The base 702 and arms 704 together form a substantially U-shaped cross section.

Coupled to a first surface 708 of the base 702 (e.g., a surface that faces away from the direction of extension of the arms 704) is a channel retention mechanism 710. In one embodiment, the channel retention mechanism 710 comprises two side bars 712 and a center bar 714. In one embodiment, each of the two side bars 712 is substantially L-shaped and extends upward from an edge 703*a* or 703*b* of the base 702 that is substantially normal to the edges 701*a* and 701*b* from which the arms 704 extend. Each side bar 712 comprises a first portion 716 that extends upward from the base 702 and a second portion 718 that extends inward from the first section 716 in a manner substantially parallel to the base 702. The center bar 714 is positioned on the first surface 708 of the base 702, between the side bars 712, and in one embodiment is substantially rectangular in shape, having opposite edges 720*a* and 720*b* that are substantially parallel to the side bars 712.

Figure 8:
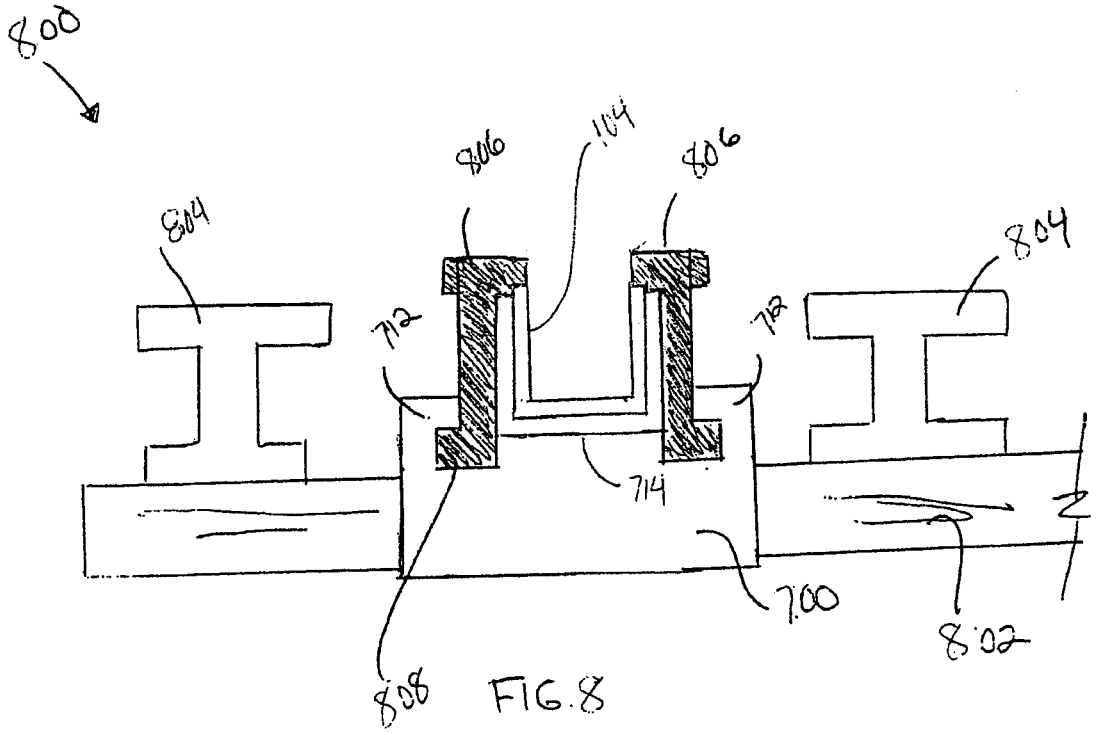
FIG. 8 is a cross sectional view illustrating the track adapter of FIG. 7 deployed in a track system.

FIG. 8 is a cross sectional view illustrating the track adapter 700 of FIG. 7 deployed in a track system 800. As illustrated, the track adapter 700 fits over a tie 802, in between two train rails 804. The track adapter 700 is adapted to receive two anchoring mechanisms 806 (e.g., stepped J-beams) for securing a flexible electric model automobile channel, so that each anchoring mechanism 806 is positioned between the center bar 714 and one side bar 712. The second portions 718 of the side bars 712 are adapted to wrap over a foot 808 of an anchoring mechanism 806, in order to secure the flexible model electric automobile channel in place. The track adapter 700 thereby secures the anchoring mechanisms 806 in a parallel, spaced apart orientation, so that a flexible model electric automobile (not shown) may travel along the model electric automobile channels held in place by the anchoring mechanisms 806.

Although the track adapter 700 has been illustrated in FIGS. 7 and 8 as having a U-shaped base cross section that wraps around a railroad tie 802, those skilled in the art will appreciate that the track adapter 700 may be formed without the arms 704 extending from the base 702, so that the base 702 may be fixed directly to a portion of the railroad tie 802 (for example using an adhesive such as glue or epoxy). This configuration would be especially beneficial for use with model railroad track layouts having simulated roadbeds.

Figure 9:
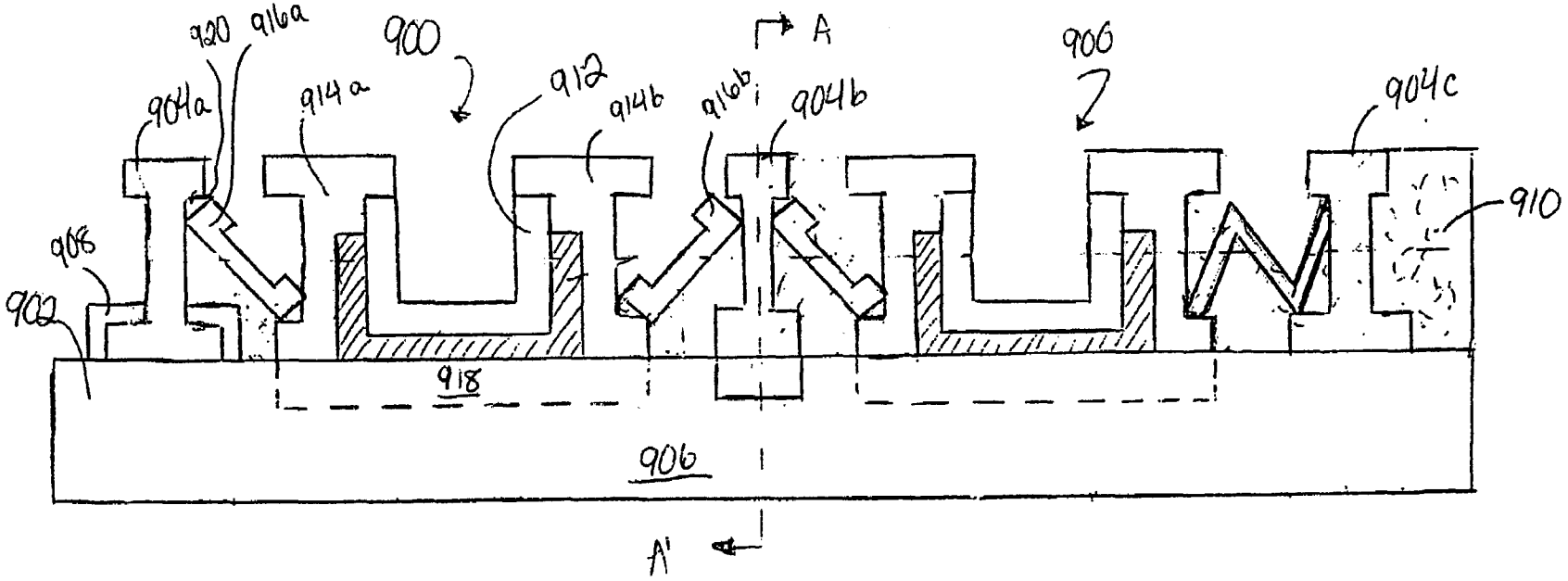
FIG. 9 is a cross-sectional view of third embodiment of a track adapter 900 deployed within a model railroad track layout 902.

FIG. 9 is a cross-sectional view of third embodiment of a track adapter 900 deployed within a model railroad track layout 902. The model railroad track layout 902 is substantially similar to the model railroad track layout 600 illustrated in FIG. 6 and comprises three model train rails 904*a*, 904*b* and 904*c* (hereinafter collectively referred to as "model train rails 904") supported upon a plurality of spaced apart ties 906. In some embodiments, the model railroad track layout 902 further comprises a plurality of spikes 908 for anchoring the model train rails 904 to the ties 906 (e.g., as illustrated to the left of line A-A'). Moreover, as discussed above with respect to FIG. 1, some embodiments of the model railroad track layout 902 further comprise a textured surface such as a simulated roadbed 910 (e.g., as illustrated to the right of line A-A'). In one embodiment, the model railroad track layout 902 is a flexible model railroad layout formed at least partially of a flexible material such as a flexible plastic.

The track adapter 900 is adapted for deploying a single self-adjusting flexible channel 912 (e.g., comprising, an inner channel, an outer channel and a stop as described above) between two model train rails (e.g., between the center rail 904*b* and one of the side rails 904*a* or 904*c*) of the pre-existing model railroad track layout 902. As illustrated, two track adapters 900 are deployed, one track adapter 900 on either side of the center model train rail 904*b*, to deploy two self-adjusting flexible channels 912, thereby enabling a model electric vehicle configured for use with the self-adjusting flexible channels 912 to travel along the model railroad track layout 902.

The track adapter 900 comprises two retention mechanisms 914*a* and 914*b* (hereinafter collectively referred to as "retention mechanisms 914") and two anchoring mechanisms 916*a* and 916*b* (hereinafter collectively referred to as "anchoring mechanisms 916"). In one embodiment, both the retention mechanisms 914 and the anchoring mechanisms 916 are formed of a flexible material such as plastic, so that the track adapter 900 is bendable with the model railroad track layout 902 and the self-adjusting flexible channels 912. The retention mechanisms 914 serve to hold the self-adjusting flexible channels 912 in place in the model railroad track layout 902. In one embodiment, the retention mechanisms 914 are J-beams substantially similar in form and function to the J-beams 204 illustrated in FIG. 2. In one embodiment, the J-beams are coupled by a connecting bar 918 (illustrated in phantom) to form a single, solid structure.

One anchoring mechanism 916 is positioned between each retention mechanism 914 and its opposing model train rail 904. Each anchoring mechanism 916 is configured to catch under a lip 920 of the opposing model train rail 904 such that the anchoring mechanism 916 is biased against the respective retention mechanism 914. Thus, the anchoring mechanisms 916 serves to secure the retention mechanisms 914 (and the self-adjusting flexible channels 912 positioned therein) in place in the model railroad track layout 902. In one embodiment, at least one of the anchoring mechanisms is a long C-beam that extends along the lengths of the model train rails 904 and retention mechanisms 914 (e.g., as illustrated to the left of line A-A'). In another embodiment, at least one of the anchoring mechanisms is a long Z-beam that extends along the lengths of the model train rails 904 and retention mechanisms 914 (e.g., as illustrated to the right of line A-A'). In some embodiments, use of a Z-beam for the anchoring mechanism 916 provides a greater degree of flexibility to the track adapter 900.

Thus, the present invention represents a significant advancement in the field of electric model vehicles. A track for use with electric model vehicles is provided that is easily customizable by a user. A track segment of the present invention is not only flexible to allow the user to bend the track into virtually any desired shape, but automatically adjusts to applied forces (e.g., expansion or compression due to bending) so that little to no modification is needed to connect the track to additional track segments in order to create a complete track layout.

Although the invention has been described above with reference to specific embodiments, persons skilled in the art will understand that various modifications and changes may be made thereto without departing from the broader spirit and scope of the invention as set forth in the appended claims. The foregoing description and drawings are, accordingly, to be regarded in an illustrative rather than a restrictive sense.

What is claimed is:

1. A track for use with an electric model vehicle, the track including a connection interface adapted for connection to a second track, the track comprising:

a flexible base having a first end and a second end; and at least two flexible channels coupled to the flexible base and adapted to support travel of the electric model vehicle thereon, the at least two flexible channels being adjustable such that bending forces applied to the track do not alter a geometry of the connection interface, wherein each of the at least two flexible channels comprises:

a first channel extending approximately from the first end of the flexible base to the second end of the flexible base, the first channel having a first end, a second end, and a substantially U-shaped cross section; and a second channel positioned within the first channel and having a first end, a second end, and a substantially U-shaped cross section, the second channel being shorter in length than the first channel.

2. The track of claim 1, wherein an outer width of the second channel is slightly smaller than an inner width of the first channel such that the second channel is enabled to slide longitudinally within the first channel.

3. The track of claim 2, further comprising:

a first stop positioned within the first end of the first channel; and a second stop positioned within the second end of the first channel, the first and second stops being adapted to limit travel of the second channel within the first channel.

4. A track for use with an electric model vehicle, the track including a connection interface adapted for connection to a second track, the track comprising:

a flexible base having a first end and a second end; and at least two flexible channels coupled to the flexible base and adapted to support travel of the electric model vehicle thereon, the at least two flexible channels being adjustable such that bending forces applied to the track do not alter a geometry of the connection interface, wherein the flexible base further comprises:

at least four ties coupled to the flexible base, a single flexible channel being secured by at least two of the at least four ties; and at least four J-beams, each of the at least four J-beams being adapted to engage one of the at least four ties and being further adapted to secure one of the at least two flexible channels to the base.

5. A track for use with an electric model vehicle comprising:

a flexible base having a first end and a second end; and at least two flexible channels coupled to the base and adapted to support travel of the electric model vehicle thereon, the at least two flexible channels each comprising:

a first channel extending approximately from the first end of the flexible base to the second end of the flexible base, the first channel having a first end, a second end, and a substantially U-shaped cross section; and a second channel positioned within the first channel and having a first end, a second end, and a substantially U-shaped cross section, the second channel being shorter in length than The first channel.

6. The track or claim 5, wherein an outer width of the second channel is slightly smaller than an inner width of the first channel such that the second channel is enabled to slide longitudinally within the first channel.

* * * * *